United States Patent [19]

Hokari et al.

[11] Patent Number: 4,474,122

[45] Date of Patent: Oct. 2, 1984

[54] METHOD FOR PROTECTING EQUIPMENT AUXILIARY TO FLUIDIZED INCINERATOR FROM CORROSION

[75] Inventors: Hiroshi Hokari, Kamakura; Shiro Imaizumi, Yokohama, both of Japan

[73] Assignees: Toyo Engineering Corporation; Nippon Zeon Co., Ltd., both of Tokyo, Japan

[21] Appl. No.: 412,408

[22] Filed: Aug. 27, 1982

[30] Foreign Application Priority Data

Oct. 16, 1981 [JP] Japan ..... 56-164283

[51] Int. Cl.[3] ..... F23D 1/00

[52] U.S. Cl. ..... 110/347; 110/346; 110/245

[58] Field of Search ..... 110/243–245, 110/343, 346, 347; 122/40

[56] References Cited

U.S. PATENT DOCUMENTS 4,312,280 1/1982 Shearer et al. ..... 110/347

FOREIGN PATENT DOCUMENTS 2079890 2/1970 France ..... 110/346
105110 8/1980 Japan ..... 110/245
91113 7/1981 Japan ..... 110/245
113918 9/1981 Japan ..... 110/343

*Primary Examiner*—Henry C. Yuen
*Attorney, Agent, or Firm*—Flynn, Thiel, Boutell & Tanis

[57] ABSTRACT

A method for protecting one or more metallic materials of equipment auxiliary to a fluidized incinerator from corrosion, said fluidized incinerator being adapted to cause waste materials including a chlorine-containing compound to burn to ashes and said metallic materials being exposed to a combustion gas and heated to a temperature of at least 450° C. at their surfaces, which method comprises causing an alkali metal or alkaline earth metal carbonate to be present in the ashes at a rate of 0.3–5 equivalents based on all the chlorine contained in the ashes present in the equipment.

3 Claims, 1 Drawing Figure

METHOD FOR PROTECTING EQUIPMENT AUXILIARY TO FLUIDIZED INCINERATOR FROM CORROSION

BACKGROUND OF THE INVENTION (1) Field of the Invention

This invention relates to a method for protecting high temperature areas of equipment or facilities auxiliary to a fluidized incinerator from corrosion. Such high temperature areas include, for example, metallic areas exposed to combustion gas of high temperature such as cyclone dust collector, air preheater, waste heat boiler, their piping and the like which are provided in connection with the main body of the incinerator.

(2) Description of the Prior Art

A fluidized incinerator has such merits that it can handle a larger volume of waste materials per unit area and it promotes their perfect combustion. Fluidized incinerators have thus found wide-spread commercial utility as incinerators for municipal and industrial waste. These municipal and industrial wastes, however, contain chlorine-containing compounds and, upon burning, produce hydrogen chloride (HCl) gas and the like, thereby subjecting incinerators and their auxiliary equipment or facilities to corrosion and shortening their service life to impose big limitation on the recovery of theremal energy. It has thus been attempted to solve the above problems by using a heat and corrosion resistant steel material as a structural material or by supplying an alkaline compound into fluidized incinerators to neutralize and remove acidic gas produced in the course of combustion.

However, even if the acidic gas is neutralized and its concentration in the combustion gas is lowered to any considerable extent, it has been recognized that corrosion still takes place, especially at ash-covered areas because metals are heated to 450° C. or higher at their surfaces in the equipment, facilities and piping auxiliary to a fluidized incinerator. If one wants to avoid corrosion at high temperatures, it is necessary to keep the temperature at the surface of a steel material below 450° C. For this purpose, it has been a practice to lower the temperature of the combustion gas by spraying water or blowing cold air into the combustion gas or by increasing the flow velocity of a heat transfer medium in each heat exchanger. These measures, however, impose tremendous limitations when recovering energy from the combustion gas. For example, in the case of recovering the energy of combustion gas in the form of electric power by means of a steam turbine, lowered surface temperatures lead to a lowered pressure and a reduced volume of steam generated, thereby lowering the efficiency of heat recovery.

A variety of investigations and research have heretofore been done with respect to high temperature corrosion of incinerators. It has been known that the presence of HCl in combustion gas accelerates the corrosion and induces violent corrosion at temperatures above a certain level. The mechanism of such corrosion has already been elucidated. Namely, Fe is reacted with HCl to form $FeCl_3$ and $Fe_2Cl_6$, followed by decomposition of these iron chlorides to iron oxides with spontaneous regeneration of HCl. HCl is also formed due to the decomposition of chlorides such as NaCl, KCl, $CaCl_2$ and the like present in incineration ashes. The thus-regenerated HCl seems to play the principal role in metal corrosion.

As counter-measures against high temperature corrosion due to hydrochloric acid, it may be effective:

(1) to periodically replace corroded parts of auxiliary equipment, considering them as expendable parts;

(2) to apply a special protective material on the surface of each part which is susceptible to corrosion; and (3) to use a high-quality corrosion-resistant material.

However, it has been reported that counter-measure (1) requires frequent interruption of the operation of the incineration plant or the installation of standby equipment for each item of equipment which is liable to undergo corrosion; and counter-measure (2) does not show any noticeable effects even if $Al_2O_3$ or its analogous refractory material is applied as a protective coating. As to counter-measure (3), the anti-corrosion effect of high chromium steel has been reported. However, such materials are costly and involve certain problems in their mechanical properties, thereby making themselves unsuitable for practical use. Under such circumstances, it is common practice to avoid the development of high temperature corrosion by, for example, lowering the temperature of each metal surface which is brought into contact with combustion gas of elevated temperature, as mentioned above.

SUMMARY OF THE INVENTION

An object of this invention is to provide a method for readily preventing at low expense the surface corrosion of one or more metals of equipment auxiliary to a fluidized incinerator for waste materials containing a chlorine-containing compound, which metal is exposed at its surface to combustion gas of high temperature.

The present inventors discovered that the corrosion of steel material of such auxiliary equipment takes place at the surface of each steel material which surface is exposed to high temperatures and covered with incineration ashes. They carried out a variety of research with a view toward developing an effective method to inhibit such corrosion. As a result, they have succeeded in preventing the corrosion in accordance with the following method:

In a method for protecting one or more metallic materials of equipment auxiliary to a fluidized incinerator from corrosion, said fluidized incinerator being adapted to cause waste materials including a chlorine-containing compound to burn to ashes and said metallic materials being exposed to a combustion gas and heated to a temperature of at least 450° C. at their surfaces, the improvement comprising causing an alkali metal or alkaline earth metal carbonate to be present in the ashes at a rate of 0.3–5 equivalents based on all the chlorine contained in the ashes present in the equipment.

DETAILED DESCRIPTION OF THE INVENTION

Figure 1:
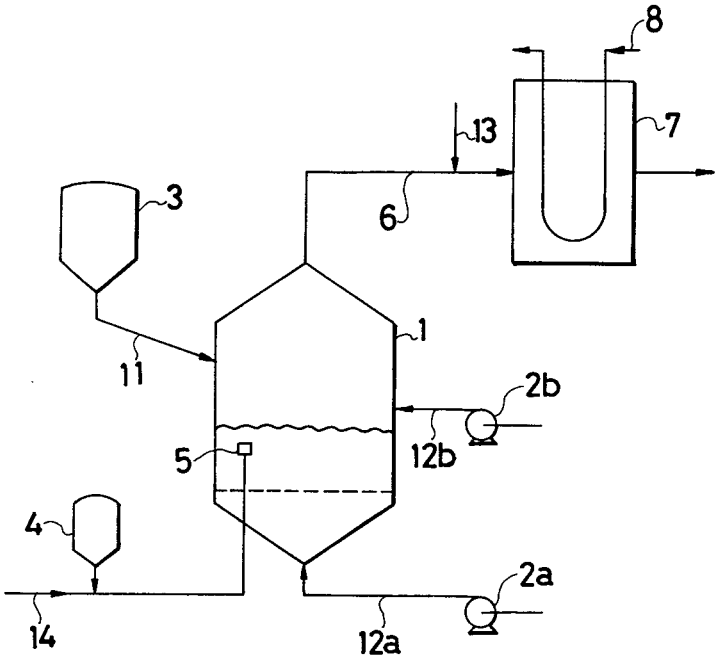
FIG. 1 is a flow sheet showing one embodiment of the present invention.

As exemplary alkali metal and alkaline earth metal carbonates useful in the practice of the method according to this invention, may be mentioned, respectively, sodium carbonate, potassium carbonate and the like; and calcium carbonate, magnesium carbonate and the like. Sodium hydroxide, calcium hydroxide, etc. may also be employed, but their effectiveness is not so great as that available from the use of the aforementioned carbonates. It is desirable to use such carbonates in a powder form containing at least 50 wt. % of particles of 0.5 mm or smaller, since use of such powdery carbonates can bring about the effects of the present invention to the maximum. Namely, when the powder of each of the above carbonates is added into a fludized bed, it undergoes a reaction with an acidic gas, which occurs in the fluidized bed, to form a salt. Unreacted smaller particles of the carbonate are suspended together with ashes which have resulted from the incineration and cover as a mixture with ashes the metallic surface of auxiliary equipment, thereby protecting the metallic surface from corrosion. Sodium carbonate is particularly convenient among the aforementioned carbonates, because it is effective in both suppressing the corrosive action of incineration ashes at elevated temperatures and in removing acidic gases such as HCl and the like.

In order to have such a carbonate be present uniformly in the aforementioned covering ashes and to inhibit corrosion, the content of the carbonate in the ashes is critical. As a result of various experiments, it has been found that the content of the carbonate should range from 0.3 to 5 equivalents based on the chemical equivalents of all the chlorine present in ashes accompanied by a combustion gas from an incinerator (inclusive of the chlorine contained in the salt if any). Any amounts less than 0.3 equivalent are too little to draw out a sufficient corrosion inhibitory effect whereas it is not economical to use such a carbonate beyond 5 equivalents.

The carbonate may generally be added, for example, by charging the carbonate powder into the fluidized bed, for instance, together with air; or by feeding the carbonate powder into the fluidized bed by means of a screw feeder. The effects of this invention may be derived to the maximum when carbonate powder is injected at a velocity 30–300 times the flow velocity of the fluidizing medium in the fluidized bed through an injection nozzle provided at a position which is spaced from the outer circumference of the fluidized bed by a distance equivalent to one third the diameter of the fluidized bed or shorter and also from the bottom of the fluidized bed by a distance equivalent to three fifths the height of the fluidized bed, and preferably opening in the horizontal direction.

According to the present invention, it is possible to inhibit corrosion at highly heated metallic parts of equipment auxiliary to a fluidized incinerator, which is operated under the conditions below, by incorporating an alkali metal or alkaline earth metal carbonate in ashes covering the metallic parts. The method of the present invention requires little expense and enables the metallic parts to be used over a prolonged period of time.

| Operating Conditions of Fluidized Incinerator | |
|---|---|
| (1) Waste load to hearth: | |
| Municipal waste | 350–600 kg/m$^2$ of floor area, respectively. |
| (calorific value | 800–2500 kcal/kg) |
| Industrial waste | 50–300 kg/m$^2$ of floor area, respectively. |
| (calorific value | 7000 kcal/kg) |
| (2) Heat load to combustion chamber: | 150,000 kcal/m$^3$ or less |
| (3) Temperature of fluidized medium bed: | 400–850° C. |
| (4) Gas temperature at heat exchanger inlet: | 750–950° C. |

-continued

| Operating Conditions of Fluidized Incinerator | |
|---|---|
| (5) Flow velocity of gas in fluidized bed: | 0.5–4 m/sec. |
| (6) Composition of combustion gas: | |
| $O_2$ | 5–15 vol. % |
| $CO_2$ | 5–15 vol. % |
| $H_2O$ | 10–30 vol. % |

Since the method according to the present invention can inhibit the high temperature corrosion of equipment auxiliary to a fluidized incinerator, particularly, boiler tubes, it is feasible to produce steam of high temperature and pressure from a waste heat boiler. It is thus possible to considerably improve the efficiency of power generation compared with the prior art methods, by employing steam of high temperature and pressure for power generation.

The present invention will hereinafter be described in further detail in accordance with the following examples:

EXAMPLE 1

In an electric furnace having an inner diameter of 54 mm and heated to 600° C., were placed plate-like SUS 321 test pieces of 30 mm long×50 mm wide and 4 mm thick, each in a porcellaneous tray. The acronym "SUS" is a standard indication of stainless steels according to the Japanese Industrial Standard. The upper surface of each test piece was covered with NaCl or a powdery mixture of NaCl and $Na_2CO_3$ to a thickness of 3 mm. Air containing 30 vol. % of water and preheated to 150° C. was charged at a rate of 7 liters/minute into the furnace. The temperature in the furnace was maintained at 600° C. by means of an electric heater.

The test pieces were maintained under the above conditions for 24 hours, 72 hours and 120 hours, respectively, and taken out of the furnace. After brushing ashes off from the upper surface of each test piece, the resulting scales were removed with an aqueous solution of an alkaline oxidizing agent (NaOH 15%+$KMnO_4$ 3%) and a 10% aqueous solution of ammonium citrate. The weight loss after the heating was then determined. Incidentally, NaCl and $Na_2CO_3$ were each of reagent quality (i.e., of extra fine grade). Test results are shown in Table 1.

As will be readily seen from Table 1, the weight loss due to corrosion decreases as the content of $Na_2CO_3$ in NaCl becomes higher.

TABLE 1

| Run No. | Substance covering surface of test piece Mixing ratio of NaCl to $Na_2CO_3$ (in equivalents) NaCl | $Na_2CO_3$ | Weight loss (mg) 24 hrs. | 72 hrs. | 120 hrs. |
|---|---|---|---|---|---|
| 1 | 1 | 0 | 183 | 415 | 621 |
| 2 | 1 | 0.1 | 167 | 411 | 602 |
| 3 | 1 | 0.3 | 88 | 178 | 284 |
| 4 | 1 | 1 | 32 | 78 | 102 |
| 5 | 1 | 2 | 30 | 80 | 95 |

EXAMPLE 2

Using the same electric furnace as that used in Example 1 and following the procedure of Example 1, except that the substance covering the upper surface of each test piece was changed to $CaCl_2$ or a mixture of $CaCl_2$ and $CaCO_3$, the temperature in the furnace was lowered to 450° C. Each test piece was kept for 24 hours in the furnace and its weight loss after the heating was determined. $CaCl_2$ and $CaCO_3$ were each of reagent quality (i.e., of extra fine grade). Results are given in Table 2. As is apparent from Table 2, the weight loss due to corrosion can also be reduced by the incorporation of $CaCO_3$.

TABLE 2

| Run No. | Substance covering surface of test piece Mixing ratio of $CaCl_2$ to $CaCO_3$ (in equivalents) $CaCl_2$ | $CaCO_3$ | Weight loss (mg) 24 hours |
|---|---|---|---|
| 1 | 1 | 0 | 254 |
| 2 | 1 | 0.4 | 183 |
| 3 | 1 | 3 | 74 |

EXAMPLE 3

Using the same electric furnace, test pieces (SUS 321), maintenance temperature (600° C.) and maintenance time periods (24 hrs. 72 hrs. 120 hrs.) as those employed in Example 1, the procedure of Example 1 was followed except that the substance covering each test piece was changed to ashes collected from a cyclone dust collector which was installed right behind a fluidized incinerator for municipal waste (the content of all the chlorine: 2.1%), a mixture of the ashes and $Na_2CO_3$ or $K_2CO_3$. Results are shown in Table 3.

As will be appreciated from Table 3, remarkable corrosion-inhibitory effects are available against corrosion due to incineration ashes occurring from a fluidized incinerator when $NaCO_3$ or $K_2CO_3$ is incorporated in the ashes.

TABLE 3

| Run No. | Substance covering surface of test piece | Weight loss (mg) 24 hrs. | 72 hrs. | 120 hrs. |
|---|---|---|---|---|
| 1 | Ashes | 104 | 173 | 241 |
| 2 | Ashes + $Na_2CO_3$ (0.15 equivalent based on all the chlorine in the ashes) | 96 | 151 | 214 |
| 3 | Ashes + $Na_2CO_3$ (0.5 equivalent based on all the chlorine in the ashes) | 61 | 88 | 134 |
| 4 | Ashes + $Na_2CO_3$ (1 equivalent based on all the chlorine in the ashes) | 38 | 68 | 77 |
| 5 | Ashes + $K_2CO_3$ (1 equivalent based on all the chlorine in the ashes) | 55 | 71 | 92 |

EXAMPLE 4

Using the same electric furnace as that used in Example 1, the procedure of Example 1 was repeated except for the replacement of the test pieces by SUS 410 and the substitution of ashes collected from an electric dust collector of a fluidized incinerator for municipal waste (the content of all the chlorine: 14.3%) for the substance covering each sample piece. Each sample piece was maintained for 24 hours in the electric furnace. The weight change of each test piece after the heating is shown in Table 4. From the results, it can be seen that the method of the present invention shows corrosion-reducing effects also against ashes containing chlorine in a high concentration.

TABLE 4

| Run No. | Substance covering surface of test piece | Weight loss (mg) 24 hours |
|---|---|---|
| 1 | Ashes | 537 |
| 2 | Ashes + $Na_2CO_3$ (0.5 equivalent based on all the chlorine in the ashes) | 227 |
| 3 | Ashes + $Na_2CO_3$ (1.5 equivalents based on all the chlorine in the ashes) | 113 |

EXAMPLE 5

In an electric furnace having an inner diameter of 83 mm and heated to 600° C., was placed a plate-like SUS 321 test piece of 30 mm long×50 mm wide and 4 mm thick in a porcellaneous tray. The upper surface of the test piece was covered with the ashes from the cyclone dust collector, which ashes were the same ones as those used in Example 3, or a mixture of the ashes and $Na_2CO_3$ powder to a thickness of 3 mm. A gaseous mixture consisting of 30 vol. % of $H_2O$, 10 vol. % of $CO_2$, 1500 ppm of HCl and the remainder of air was preheated and charged at a rate of 10 liters/minute into the furnace. The interior of the furnace was maintained at 600° C., and the test pieces were taken out of the furnace one by one after 24 hrs., 72 hrs. and 120 hrs., respectively. Similar to Example 1, the weight loss of each test piece after the heating was determined. Results are shown in Table 5.

It will be appreciated that the weight loss due to corrosion can be reduced owing to the inclusion of $Na_2CO_3$ in ashes even if the gaseous atmosphere contains HCl.

TABLE 5

| Run No. | Substance covering surface of test piece | Weight loss (mg) 24 hrs. | 72 hrs. | 120 hrs. |
|---|---|---|---|---|
| 1 | Ashes | 412 | 847 | 1176 |
| 2 | Ashes + $Na_2CO_3$ (1 equivalent based on all the chlorine in the ashes) | 63 | 94 | 128 |
| 3 | Ashes + $Na_2CO_3$ (3 equivalents based on all the chlorine in the ashes) | 52 | 80 | 91 |

EXAMPLE 6

Using the system shown in FIG. 1, a continuous incineration experiment was carried out for 11 days. Plastic waste separated from municipal waste was ground in a cutting machine and charged at a rate of about 300 kg/hr. from a hopper 3, through a line 11, into a cylindrical fluidized incinerator 1 having a diameter of 2.5 m. On the other hand, air was supplied at a flow rate of about 6,500 $m^3$/hr at normal conditions by air blowers *2a*, *2b* through their respective lines *12a*, *12b* to burn up the plastic waste.

The resulting combustion gas of 800°-850° C. was drawn out from the top of the incinerator and guided through a flue 6, where the combustion gas was sprayed with water from a line 13. Thus, the temperature of the combustion gas was about 700° C. at the inlet of a steam superheater 7. Sodium carbonate powder containing at least 90 wt. % of particles having a particle size of 0.5 mm or smaller was fed at a rate of 75 kg/hr. into the fluidized bed, from a hopper 4, by means of a flow of air supplied through a line 14, via an injection nozzle 5 disposed in the fluidized bed. Sodium carbonate of the above quantity corresponds to about 2.6 equivalents based on all the chlorine present in the plastics. Into a U-shaped SUS 321 pipe having an inner diameter of 18 mm used as a steam superheater 8, there was introduced steam of about 5 kg/cm$^2$G and about 150° C.

During the experiment period, the hydrogen chloride in the combustion gas was reduced to a range of 0–71 ppm.

The flow rate of the steam was controlled in such a way that the surface temperature of the steam superheater 8 became about 600° C. at the outlet of the steam. Upon completion of the experiment, the surface of the steam superheater 8 was observed. No corrosion was observed even where it was covered with ashes stuck thereon.

What is claimed is:

1. A method for protecting one or more metallic surfaces of equipment auxiliary to a fluidized incinerator from corrosion, said fluidized incinerator being adapted to burn waste materials including a chlorine-containing compound to ashes, said metallic surfaces being exposed to a combustion gas and having a temperature of at least 450° C. with corrosion occurring particularly at the portion of said metallic surfaces covered with said ashes, comprising the step of injecting particles of a carbonate substance horizontally into a fluidized bed formed within said fluidized incinerator through an injection nozzle at a flow velocity which is 30–300 times the flow velocity of the fluidizing medium used to form said fluidized bed, said injection nozzle being spaced apart from the outer circumference of said fluidized bed by a distance not greater than one-third the diameter of said fluidized bed and being spaced apart from the bottom of the fluidized bed by about three-fifths the height of said fluidized bed, said carbonate substance being selected from the group consisting of alkali metal carbonates and alkaline earth metal carbonates, whereby said carbonate substance is present in said ashes at a ratio of 0.3–5 equivalents of said carbonate substance based on all of the chlorine contained in said ashes, said carbonate substance containing at least 50 wt. % of particles having a particle size of 0.5 mm diameter or smaller.

2. The method as claimed in claim 1 wherein said carbonate substance is sodium carbonate.

3. A method of reducing corrosion of metal surfaces which are located in an incineration system downstream from a fluidized bed incinerator and are heated to high temperatures, which comprises: feeding waste material comprising chlorine-containing compounds into said fluidized bed incinerator, simultaneously feeding air into said incinerator so as to form a fluidized bed of said waste material suspended in the air and burning said waste material in said fluidized bed to form a high temperature, gaseous product of combustion having chlorine compound-containing ash suspended therein, and simultaneously injecting into said fluidized bed particles of a carbonate substance selected from the group consisting of alkali metal carbonates and alkaline earth metal carbonates so that said carbonate substance becomes uniformly mixed with said ash, at least 50 wt. % of said particles having a particle size of not larger than 0.5 mm, the amount of said carbonate substance fed into said fluidized bed incinerator providing in the mixture of said ash and said carbonate substance from 0.3 to 5 equivalents of said carbonate substance, based on the chlorine contained in said ash; then flowing said hot gaseous product of combustion containing said ash and said particles of carbonate substance into contact with metal surfaces located downstream from said incinerator so that said metal surfaces become heated to a temperature of at least 450° C., the mixture of said ash and said carbonate substance being deposited on said metal surfaces so that said carbonate substance reduces surface corrosion of said metal surfaces that are coated with ash and are at a temperature of at least 450° C.

* * * * *